US008850951B2

(12) United States Patent
Boutin, Jr.

(10) Patent No.: US 8,850,951 B2
(45) Date of Patent: Oct. 7, 2014

(54) GAS MANAGEMENT SYSTEM FOR A FIREARM

(71) Applicant: John M. Boutin, Jr., Holland, MA (US)

(72) Inventor: John M. Boutin, Jr., Holland, MA (US)

(73) Assignee: Holland Automatic Rifles LLC, Holland, MA (US)

( * ) Notice: Subject to any disclaimer, the term of this patent is extended or adjusted under 35 U.S.C. 154(b) by 39 days.

(21) Appl. No.: 13/727,839

(22) Filed: Dec. 27, 2012

(65) Prior Publication Data

US 2014/0182450 A1 Jul. 3, 2014

(51) Int. Cl.
*F41A 5/26* (2006.01)
*F41A 5/18* (2006.01)
*F41A 5/24* (2006.01)

(52) U.S. Cl.
CPC ..... *F41A 5/18* (2013.01)
USPC ..... 89/193

(58) Field of Classification Search
CPC ..... F41A 5/26; F41A 5/28; F41A 5/18; F41A 5/20
USPC ..... 42/79, 107, 112; 89/193, 14.5, 14.3, 89/14.2, 198, 191.01
See application file for complete search history.

(56) References Cited

U.S. PATENT DOCUMENTS

| | | | | |
|---|---|---|---|---|
| 2,223,671 | A * | 12/1940 | Nielsen | 89/193 |
| 2,340,293 | A * | 2/1944 | Balleisen | 138/45 |
| 2,382,411 | A * | 8/1945 | Green | 89/193 |
| 7,971,518 | B2 * | 7/2011 | Adams | 89/191.01 |
| 2011/0023699 | A1 * | 2/2011 | Barrett | 89/193 |
| 2013/0025445 | A1 * | 1/2013 | Windauer | 89/193 |

* cited by examiner

*Primary Examiner* — Samir Abdosh
*Assistant Examiner* — John D Cooper
(74) *Attorney, Agent, or Firm* — Bennet K. Langlotz; Langlotz Patent & Trademark Works, Inc.

(57) ABSTRACT

A gas management system for a firearm has a body including an end and having a plurality of apertures that communicate with a central body bore and a sleeve that closely receives the end of the body. One of the body apertures communicates with a barrel aperture that communicates with a barrel bore. One of the body apertures is a forward aperture that is continuously exposed and exhausts gas to the environment as the sleeve reciprocates between a forward position and a rearward position as the firearm cycles. One of the body apertures may be a rearward aperture that is not continuously exposed and only exhausts gas to the environment when the sleeve uncovers the rearward aperture as the sleeve moves to the rearward position.

25 Claims, 5 Drawing Sheets

GAS MANAGEMENT SYSTEM FOR A FIREARM

REFERENCE TO RELATED APPLICATION

This is a Continuation-in-Part of U.S. patent application Ser. No. 12/658,211, filed Feb. 4, 2010, entitled "BOLT CARRIER IMPINGEMENT DEVICE FOR A FIREARM."

FIELD OF THE INVENTION

The present invention relates to firearms, and more particularly to a gas management system for a firearm that expels a portion of high-pressure gas from the cartridge being fired in a direction that counters the recoil, torque twist, and muzzle rise normally associated with conventional high velocity projectile weapons.

BACKGROUND OF THE INVENTION

Gas operation is a system of operation used to provide energy to operate autoloading firearms. In gas operation, a portion of high pressure gas from the cartridge being fired is used to power a mechanism to extract the spent case and chamber a new cartridge. Energy from the gas is harnessed through either a port in the barrel or a trap at the muzzle. This high-pressure gas impinges on a surface such as a piston head to provide motion for unlocking of the action, extraction of the spent case from the chamber, ejection of the spent case, cocking of the hammer or striker, chambering of a fresh cartridge, and locking of the action.

Most current gas systems employ some type of piston or sleeve. The face of the sleeve is acted upon by gas from the combustion of the propellant from the barrel of the firearm. With a short-stroke or tappet system, the sleeve moves separately from the bolt group. It may operate through a connecting rod or assembly. The rod mechanically engages a bolt carrier impingement device, pushing the bolt carrier backward after the firing of the cartridge. The energy is imparted in a short, violent push, and the motion of the sleeve is then arrested by a return spring. This allows the bolt carrier assembly to continue through the operating cycle using kinetic energy.

While gas piston operating systems generally work well, the sharp impulse forces applied to the bolt carrier impingement device by the rod can be substantial. In fact, these forces can loosen the bolt carrier impingement device from the bolt carrier if the bolt carrier impingement device and bolt carrier are attached in a conventional manner.

Conventional gas piston operating systems also suffer from additional disadvantages. First, the high-pressure gas carries particulate matter with it that can build up and foul the sleeve. Second, firing conventional high velocity projectile weapons in fully automatic mode results in recoil, torque twist, and muzzle rise. All of these effects impair the user's ability to precisely control the firearm's aim as additional rounds are fired.

It is therefore an object of this invention to provide a gas management system for a firearm that counters the recoil, torque twist, and muzzle rise normally associated with conventional high velocity projectile weapons.

SUMMARY OF THE INVENTION

The present invention provides an improved gas management system for a firearm, and overcomes the above-mentioned disadvantages and drawbacks of the prior art. As such, the general purpose of the present invention, which will be described subsequently in greater detail, is to provide an improved gas management system for a firearm that has all the advantages of the prior art mentioned above.

To attain this, the preferred embodiment of the present invention essentially comprises a body including an end and having a plurality of apertures that communicate with a central body bore and a sleeve that closely receives the end of the body. One of the body apertures communicates with a barrel aperture that communicates with a barrel bore. One of the body apertures is a forward aperture that is continuously exposed and exhausts gas to the environment as the sleeve reciprocates between a forward position and a rearward position as the firearm cycles. One of the body apertures may be a rearward aperture that is not continuously exposed and only exhausts gas to the environment when the sleeve uncovers the rearward aperture as the sleeve moves to the rearward position. The forward aperture may open at an angle to the right of perpendicular. The rearward aperture may open upward at a forward angle and at an angle to the right of perpendicular. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
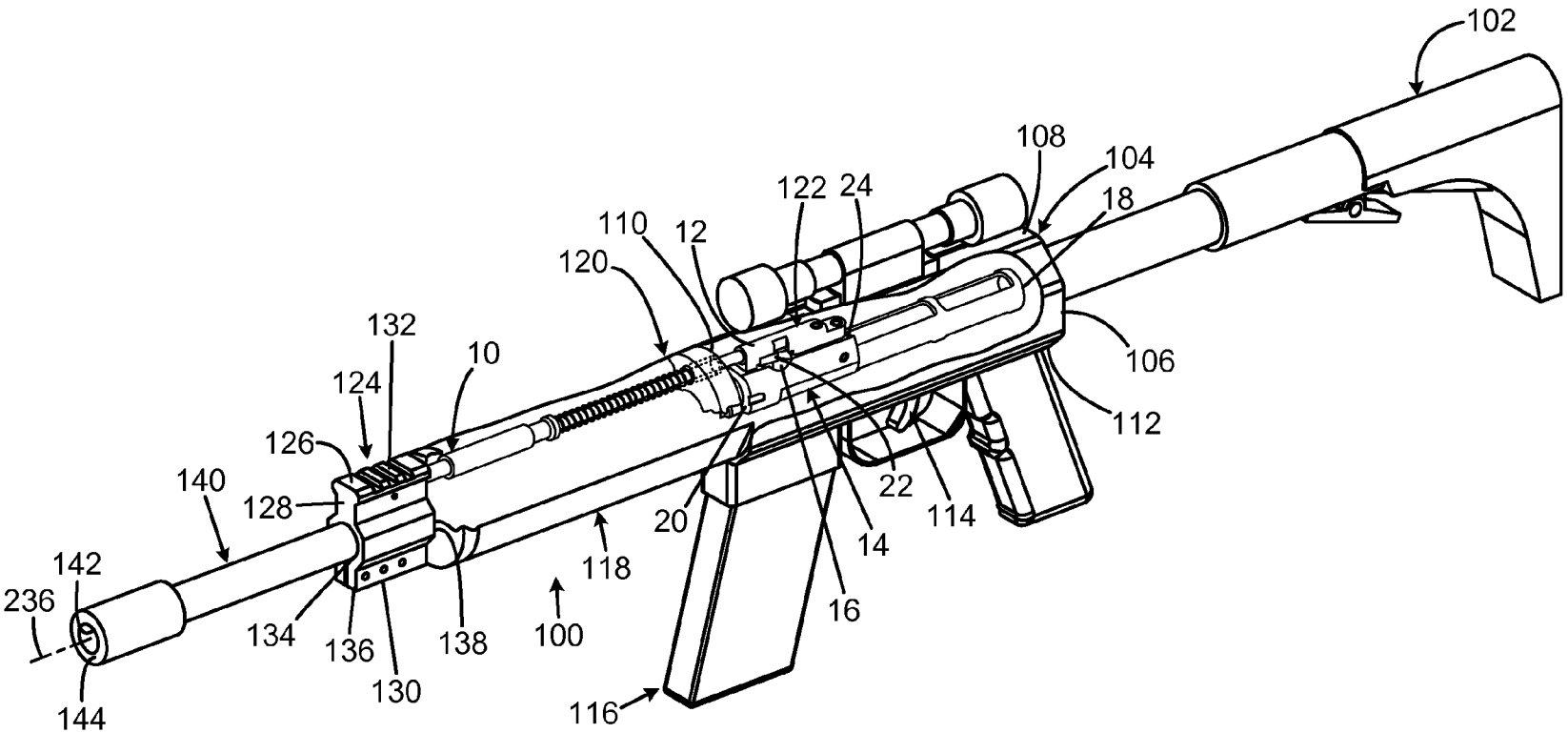
FIG. 1 is a cutaway perspective view of the gas management system for a firearm constructed in accordance with the principles of the present invention installed in a firearm.
Figure 2:
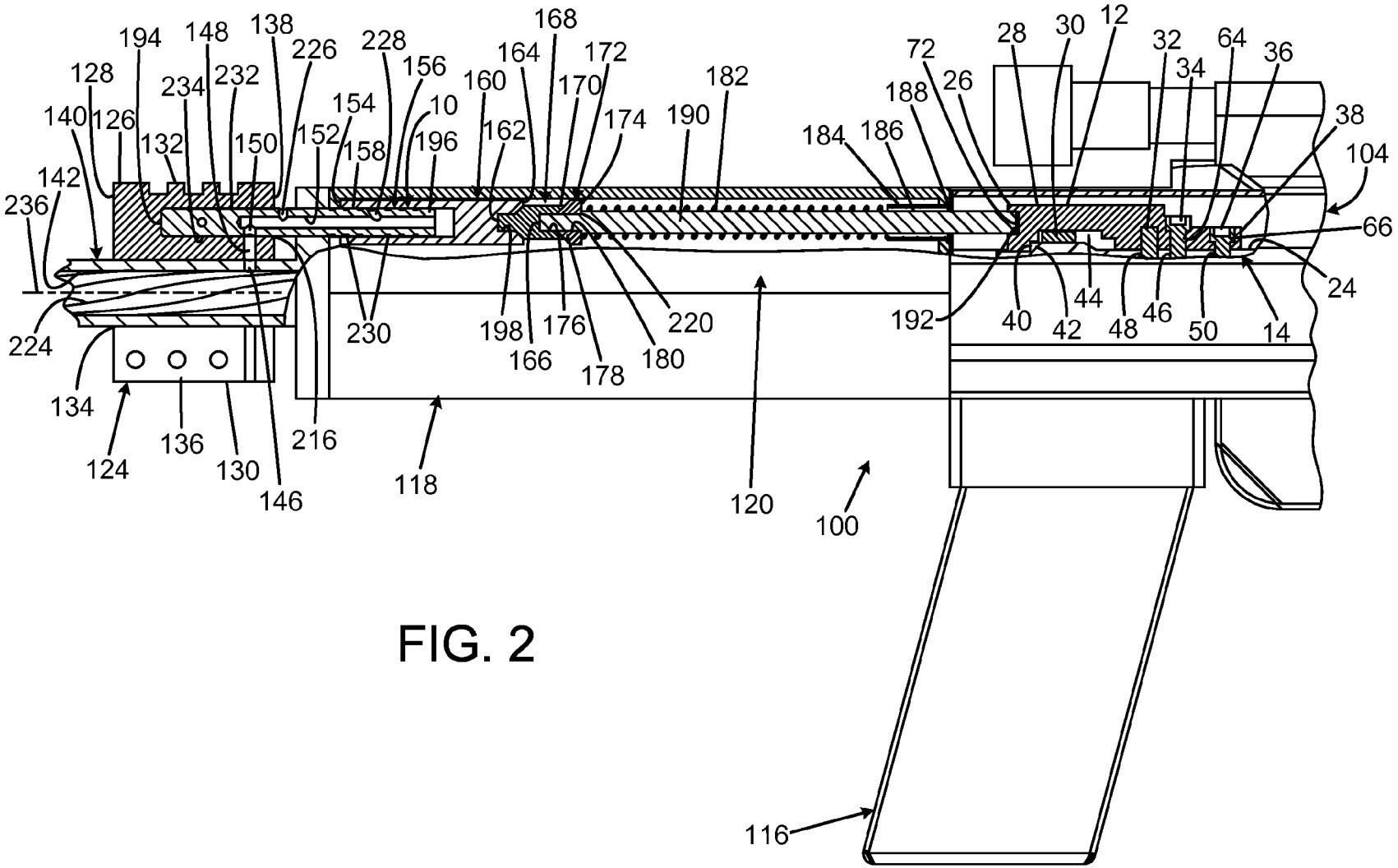
FIG. 2 is a side cutaway view of the present invention installed in a firearm.

An embodiment of the gas management system for a firearm of the present invention is shown and generally designated by the reference numeral 10.

FIGS. 1-3B illustrate the improved gas management system for a firearm 10 of the present invention installed in a firearm 100. More particularly, the firearm is a rifle having an upper receiver 104 with a stock 102 extending rearward from the rear 106. A trigger 114 and a magazine 116 extend downwardly from the upper receiver's bottom 112.

The muzzle 144 end of a barrel 140 extends forwardly from the front 110 of the upper receiver. The barrel has a central bore 142 that defines a barrel axis 236 with rifling 224. In the current embodiment, the rifling causes the rifle's torque twist to be to the right when a bullet is fired. Torque twist occurs when the bullet gets spun up by the rifling and accelerates as it passes through the barrel. An aperture 146 enables communication between the bore 142 and the exterior of the barrel.

A lower handguard 118 and an upper handguard 120 removably encircle the barrel with their rears 202 and 208 abutting the front of the upper receiver. The bottom 218 of the upper handguard defines a notch 204 in the front 200 and a notch (not visible) in the rear 202. The top 206 of the lower handguard defines a notch 212 in the front 210 and a notch 214 and the rear 208. The notches in the handguards receive the barrel 140. The front of the upper handguard defines a bore 222 in the front and an axially registered bore (not visible) in its rear. The front bore in the upper handguard receives a fixed piston 156, and the rear bore in the upper handguard receives an action rod spring bushing 184.

A gas block 124 clamps onto the barrel using a clamp 136 having a bore 134. The rear 138 of the gas block abuts the front 200 of the upper handguard and the front 210 of the lower handguard. The rear of the gas block defines a bore 216. A gas block passage 148 enables fluid communication between the bore 134 and the bore 216.

The upper receiver carries a reciprocating bolt carrier 14 that is movable between a locked position and an unlocked position. The bolt carrier supports and positions a bolt (not visible). The locked position is the position in which the bolt carrier has positioned the bolt for firing. The unlocked position is any position other than the locked position, which includes the position where the bolt carrier has retracted the bolt from the chamber to permit ejection of a casing and insertion of a cartridge from the magazine 116. The bolt carrier impingement device 122 is coupled to the bolt carrier and is employed by a gas management system 10 to move the bolt carrier between the locked and the unlocked positions.

The gas management system 10 is positioned above the barrel, extends parallel to the barrel, and terminates in an engagement with the bolt carrier impingement device 122. The gas management system has a cylindrical fixed piston 156 whose front 194 is received by the bore 216 in the rear of the gas block. The rear 196 of the fixed piston defines a bore 152. An aperture 150 located at the bottom 234 of the fixed piston enables fluid communication between the bore 152 and the gas block passage 148. A first orifice 226 located immediately behind the aperture 150 in the top 232 of the fixed piston enables fluid communication between the bore 152 and the external environment. A second orifice 228 near the top of the fixed piston is located to the rear of the first orifice 226. The second orifice enables fluid communication between the bore 152 and the external environment when the second orifice is not covered by a sleeve 160. Two sets of fluting 230 encircle the exterior of the fixed piston.

The reciprocating cylindrical sleeve 160 has a front 154 defining a bore 158. The bore 158 receives the rear of the fixed piston. The rear 164 of the sleeve defines an aperture 198. The aperture 198 receives the front 162 of a connecting link 168. The rear 170 of the connecting link defines a bore 176.

The bore 176 receives the front 166 of a rod 190. The front of the rod has a narrower diameter than the remainder of the rod, forming a shoulder 220. The front of the rod is received by a bore 180 in a rod head 172. The rear 174 of the rod head abuts the shoulder 220, and the front 178 of the rod head abuts the rear 170 of the connecting link.

The rod extends rearward and is received by a bore 186 in an action rod spring bushing 184. The action rod spring bushing is positioned on the rod where the rod passes through the aperture in the rear of the upper handguard. Subsequently, the rod passes through an aperture 188 in the front of the upper receiver. The rear 192 of the rod is received by an aperture 72 in the front 26 of the bolt carrier impingement device 122. A piston return spring 182 encircles the rod between the rod head 172 and the rearmost portion of the action rod spring bushing 184. A portion of the rear length of the piston return spring is encircled by the action rod spring bushing.

The bolt carrier impingement device 122 occupies the space of the charging handle in prior art rifles. The bolt carrier impingement device 122 has a body 12 having a top 28, a bottom (not shown), a front 26, and a rear 38. The front of the body defines an aperture 72 that receives the rear 192 of the rod 190. The bottom and left side of the body define a slot 44. The forward most portion of the slot 44 includes a step notch 40 on the bottom of the body. A retention pin 32 protrudes downwardly from the bottom of the body rearward of the slot 44. Two bores 64 and 66 pass through the rear 38 of the body behind the retention pin.

The bolt carrier 14 has a front 20, rear 18, and top 24. The top of the bolt carrier includes a camming surface in the form of an aperture 16. A cam pin (not shown) extends from the bolt carried by the bolt carrier and is received within the aperture 16. The interaction of the cam pin and aperture 16 are not described in detail as they are well known in the art. The cam pin and aperture 16 are described to provide a basis for orientation and positioning of the bolt carrier impingement device 122.

The top of the bolt carrier defines a step 42 or buttress immediately in front of the aperture 16. The top of the bolt carrier also defines a retention pin aperture 48, a first screw aperture 46, and a second screw aperture 50. The retention pin aperture, first screw aperture, and second screw aperture are located rearward of the aperture 16. The first screw aperture and second screw aperture are axially registered with the bore 64 and the bore 66 when the retention pin 32 is inserted into the retention pin aperture and the body 12 is positioned parallel to the bolt carrier.

To attach the bolt carrier impingement device 10 to the bolt carrier 14, the retention pin 32 is inserted into the retention pin aperture 48. The bolt carrier impingement device is then aligned parallel to the bolt carrier so that the step notch 40 in the slot 44 closely receives the step 42 on the top surface of the bolt carrier. The first screw 34 and second screw 36 are then inserted through the bores 64 and 66 and threadedly secured within the first screw aperture 46 and second screw aperture 50.

Upon application of force from the rod 190 to the bolt carrier impingement device, the abutting engagement between the step notch 40 and the step 42 absorbs the impact forces, transmits them to the bolt carrier, and prevents damage to the fasteners joining the bolt carrier impingement device to the bolt carrier. The slot 44 in the bottom of the bolt carrier impingement device enables the cam pin to move freely within the aperture 16 without encountering interference from the bolt carrier impingement device body 12. The slot 44 enables the forward most portion of the bolt carrier impingement device to terminate in front of the aperture 16.

Figure 3A:
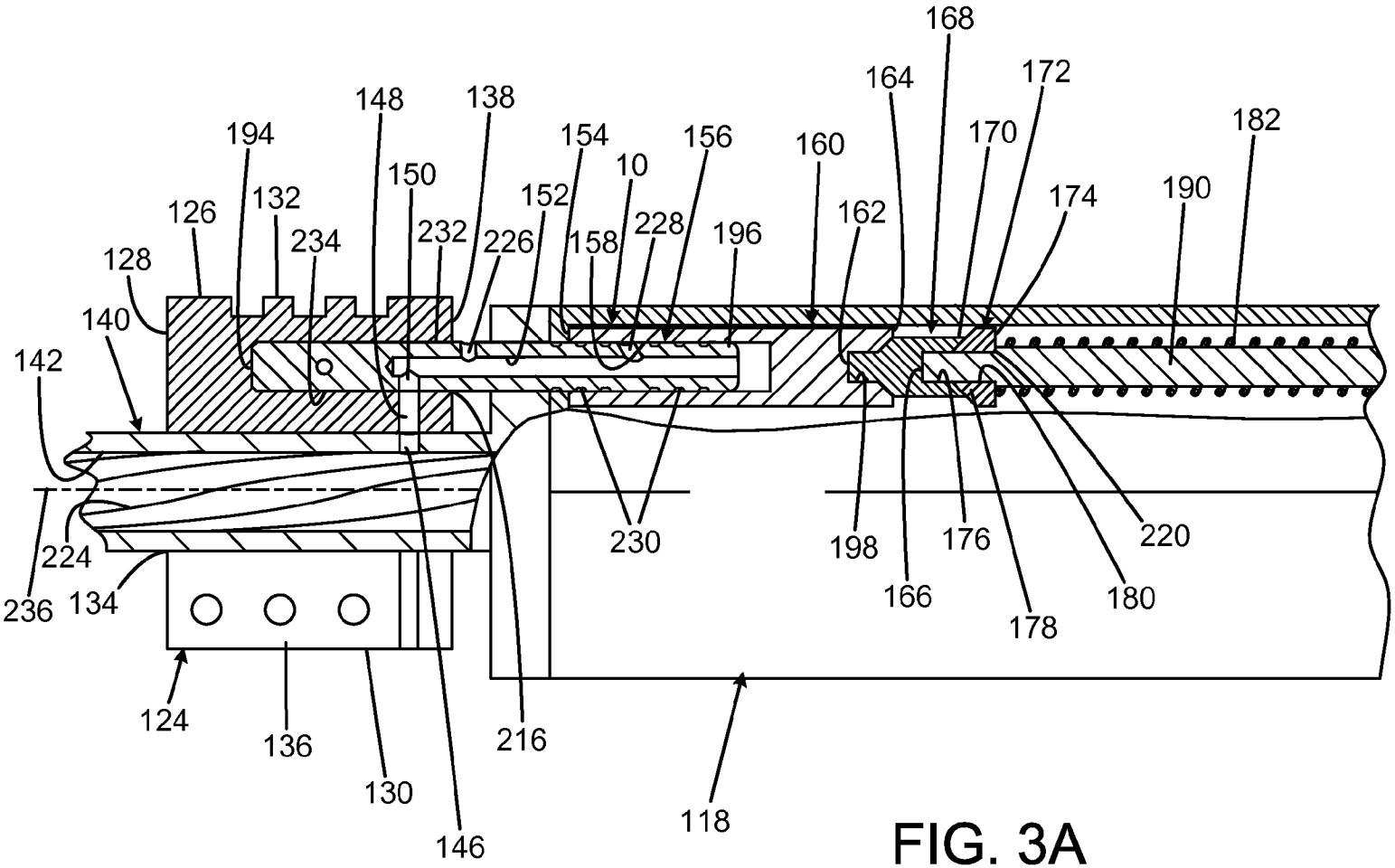
FIG. 3A is an enlarged view of the present invention installed in a firearm with the piston in its forwardmost position.

The rifle is ready for firing when the bolt carrier 14 is in the locked position with a cartridge chambered. In this condition, the reciprocating sleeve 160 is positioned as shown in FIG. 3A. When the rifle is fired by pulling the trigger 114, gas from the detonated round escapes from the barrel bore 142 through the aperture 146. The escaped gas passes through the gas block passage 148 and enters the fixed piston bore 152 though the aperture 150. The hottest and dirtiest gases are exhausted upwards into the environment through the first orifice 226. The upward burst of gas counteracts muzzle rise and limits fouling of the reciprocating sleeve 160.

The remaining cooler, lower pressure gas pushes the sleeve 160 rearward with less force than a conventional gas management system because the gas pressure is reduced by the first orifice before the sleeve begins to move. A limited, but still sufficient force is applied to the sleeve to unlock and move the bolt 52 rearward the desired amount. Through the use of the sleeve, the connecting link and rod head push the rod rearward. Rearward movement of the rod pushes against the bolt carrier impingement device, moving the bolt carrier to the unlocked position.

Figure 3B:
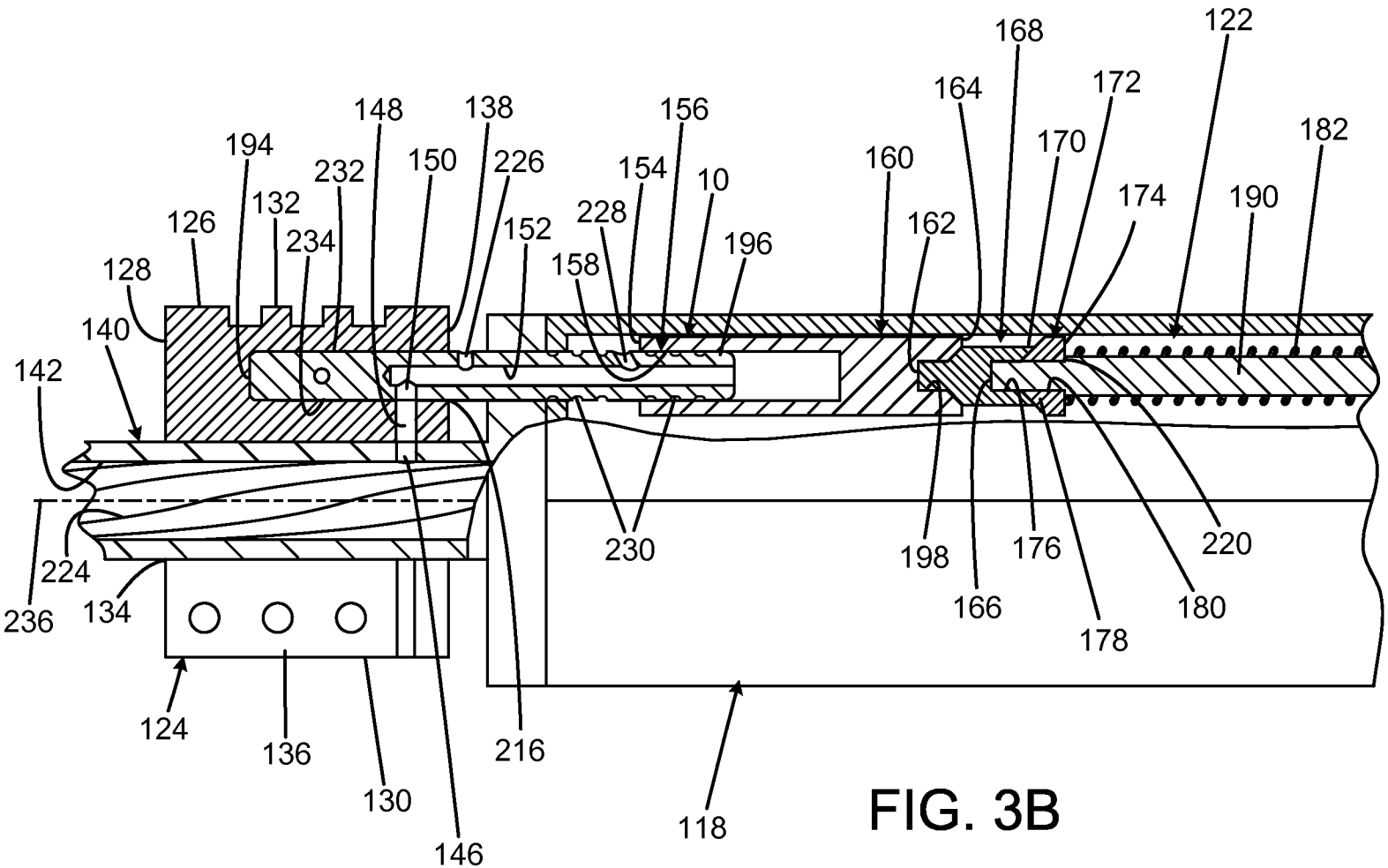
FIG. 3B is an enlarged view of the present invention installed in a firearm with the piston in its rearmost position.

As the sleeve moves to its rearmost position as shown in FIG. 3B, the second orifice 228 is uncovered when the sleeve has imparted sufficient force to unlock the bolt and move the carrier rearward. The gas expelled from the second orifice is vectored at an angle that is offset forward and to the right relative to the barrel axis 236 to counteract both muzzle rise and torque twist. This secondary release of gas at a pressure of up to 52,000 pounds per square inch quickly lowers the pressure acting upon the cylinder to the point where the pressure is less than the forward tension pressure of the return spring 182. The return spring subsequently pushes the gas management system 10 rapidly forward to enable the bolt carrier to return to its locked position without impinging on the rear of the rod. The forward movement of the sleeve closes the second orifice. The remainder of the return cycle serves to pump out the remaining gas within the bore 152 of the fixed piston through the first orifice 226 and the aperture 150, thereby cleaning the piston and cooling the fixed piston. The fluting 230 on the exterior the fixed piston serves to remove any fouling on the interior surface of the piston and provides pockets to capture any removed debris.

In a conventional firearm, similar to that described, the bolt carrier key is bolted or riveted to the top surface of a bolt carrier. Forces generated by the engagement of the rod with the bolt carrier key can result in loosening or fracturing of the junction between the bolt carrier key and the bolt carrier if they are attached in a conventional manner. Stresses caused by the force of the rod can overcome the hardware couplings of the bolt carrier key and detach it from the bolt carrier, resulting in a stoppage and possible damage or injury. In contrast, the current invention not only provides an improved bolt carrier impingement device 122, but also decreases the force of the rod substantially while still permitting proper function of the bolt carrier and bolt. The sleeve has inner and outer central conical shapes that act on the centering link and center the rod as the sleeve, centering link, and rod move rearward. As a result, the rod acts on the aperture 72 in the front surface of the bolt carrier impingement device 122 to move the bolt carrier in a straight rearward motion.

Figure 4A:
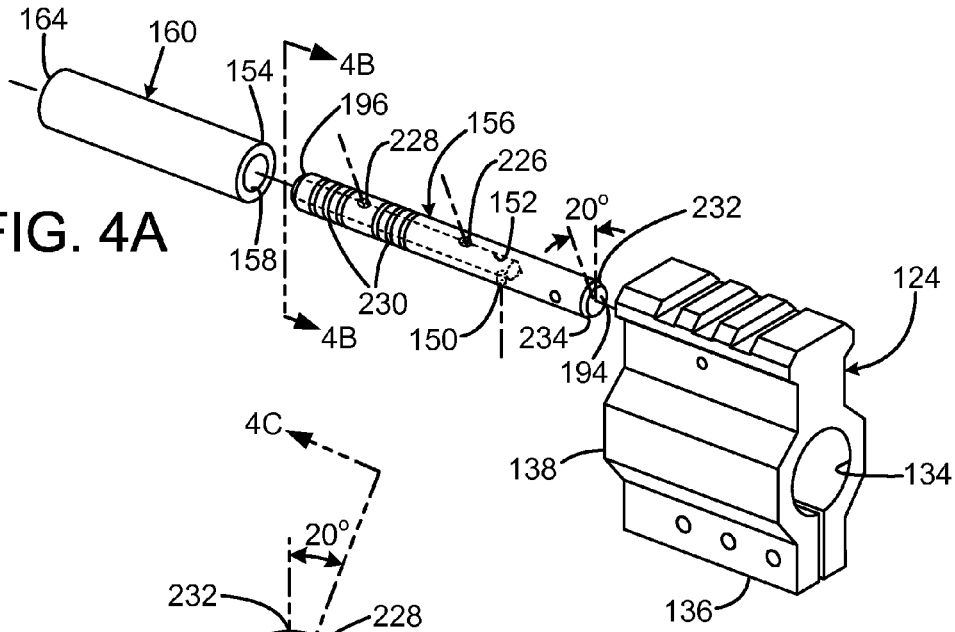
FIG. 4A is an exploded view of the piston and fixed piston of the present invention and a gas block to which the fixed piston can be attached.
Figure 4B:
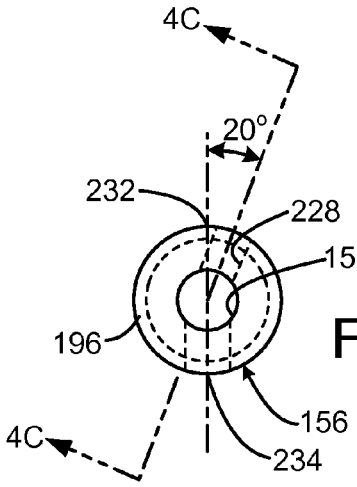
FIG. 4B is a rear view of the fixed piston of the present invention taken along the lines 4B-4B of FIG. 4A.
Figure 4C:
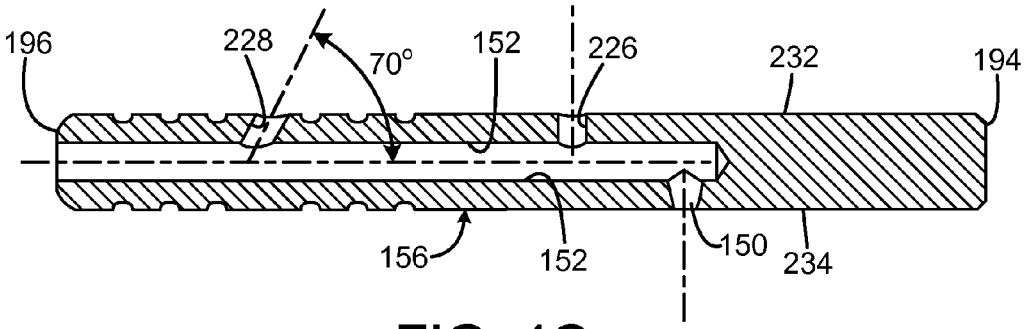
FIG. 4C is a side sectional view of the fixed piston of the present invention taken along the lines 4C-4C of FIG. 4B.

FIGS. 4A-4C illustrate the improved fixed piston 156 of the invention. More particularly, the bottom 234 of the fixed piston has an aperture 150 that opens downward perpendicular to the barrel axis 236. The top 232 of the fixed piston has a first orifice 226 that opens upward perpendicularly and 20° to the right of the barrel axis 236. The fixed piston also has a second orifice 238 located behind the first orifice that opens upward at a 70° angle with respect to the barrel axis and 20° to the right of the top of the fixed piston. The forward angle of the second orifice not only reduces muzzle rise and torque twist, but it also ensures the orifice does not become blocked by carbon buildup. As the sleeve moves forward during the return cycle, the forward angle shaves off any carbon buildup, and gas squeezes out forward as the sleeve covers it.

Note that the gas management system 10 may be employed on any type of firearm utilizing a short-stroke gas piston system for reloading, including both semi-automatic and fully automatic rifles, and the principles of the invention may be applied to other firearms systems.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a gas management system for a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gas management system for a firearm, the firearm having a barrel with an aperture that communicates with a central barrel bore comprising:

a body defining an elongated passage;

the passage having an inlet communicating with the barrel aperture, and an outlet;

the body including an end portion defining the outlet;

the body defining an intermediate aperture communicating with an intermediate portion of the passage; and a sleeve that closely receives the end portion of the body, the sleeve being operable to reciprocates between a forward position and a rearward position as the firearm cycles.

2. The system of claim 1 wherein the intermediate aperture is a rearward aperture that is not continuously exposed and exhausts gas to the environment only when the sleeve uncovers the rearward aperture as the sleeve moves to the rearward position.

3. The system of claim 2 wherein the rearward aperture opens upward at a forward angle relative to a barrel axis defined by the central bore of the barrel.

4. The system of claim 3 wherein the forward angle is 70°.

5. The system of claim 2 wherein the firearm defines a vertical medial plane when in the standard firing orientation, and wherein the rearward aperture opens at an angle offset laterally to the right of the medial plane.

6. The system of claim 5 wherein the rightward angle is 20°.

7. The system of claim 1 wherein the firearm defines a vertical medial plane when in the standard firing orientation, and wherein the intermediate aperture opens at an angle offset laterally to the right of the medial plane.

8. The system of claim 7 wherein the right ward angle is 20°.

9. The system of claim 1 wherein the intermediate aperture is continuously exposed and exhausts gas to the environment as the sleeve reciprocates between a forward position and a rearward position as the firearm cycles.

10. The system of claim 1 including a plurality of intermediate apertures, each at a different position along the length of the passage.

11. The system of claim 1 wherein the sleeve has a forward end defining a forward limit when the sleeve is in the forward position, and wherein the intermediate aperture is positioned forward of the forward limit, such that the intermediate aperture is continuously exposed.

12. The system of claim 1 wherein the sleeve has a forward end defining a forward limit when the sleeve is in the forward position, and wherein the intermediate aperture is rearward of the forward limit.

13. The system of claim 12 wherein of the sleeve defines a rearward limit when the sleeve is in the rearward position, and wherein the intermediate aperture is forward of the rearward limit, such that the intermediate aperture is intermittently exposed as the sleeve reciprocates.

14. The system of claim 1 wherein the intermediate aperture is a rearward aperture that is not continuously exposed and exhausts gas to the environment only when the sleeve uncovers the rearward aperture as the sleeve moves to the rearward position.

15. The system of claim 1 wherein the end portion has a cylindrical exterior surface.

16. A firearm comprising:

a barrel including an aperture that communicates with a central barrel bore;

a fixed cylindrical protrusion including a rear end and having a plurality of apertures that communicate with a central cylindrical protrusion bore;

a reciprocating sleeve having a forward bore that closely receives the rear end of the cylindrical protrusion;

the fixed cylindrical protrusion having a top and a bottom;

wherein one of the cylindrical protrusion apertures is an aperture at the bottom of the fixed cylindrical protrusion that communicates with the barrel aperture; and wherein one of the cylindrical protrusion apertures is a forward aperture at the top of the fixed cylindrical protrusion that is continuously exposed and exhausts gas to the environment as the sleeve reciprocates between a forward position and a rearward position as the firearm cycles.

17. The firearm of claim 16 wherein one of the body apertures is a rearward aperture adjacent to the top of the fixed cylindrical protrusion that is not continuously exposed and exhausts gas to the environment only when the sleeve uncovers the rearward aperture as the sleeve moves to the rearward position.

18. The firearm of claim 17 wherein the rearward aperture opens upward at a forward angle relative to a barrel axis defined by the central bore of the barrel.

19. The firearm of claim 18 wherein the forward angle is 70°.

20. The firearm of claim 17 wherein the firearm defines a vertical medial plane when in the standard firing orientation, and wherein the rearward aperture opens at an angle offset laterally to the right of the medial plane.

21. The firearm of claim 20 wherein the rightward angle is 20°.

22. The firearm of claim 16 wherein the firearm defines a vertical medial plane when in the standard firing orientation, and wherein the forward aperture opens at an angle offset laterally to the right of the medial plane.

23. The firearm of claim 22 wherein the rightward angle is 20°.

24. A firearm comprising:

a barrel including an aperture that communicates with a central barrel bore;

a fixed cylindrical protrusion including a rear end and having a plurality of apertures that communicate with a central cylindrical protrusion bore;

a reciprocating sleeve having a forward bore that closely receives the rear end of the cylindrical protrusion;

the fixed cylindrical protrusion having a top and a bottom;

wherein one of the cylindrical protrusion apertures is an aperture at the bottom of the fixed cylindrical protrusion that communicates with the barrel aperture;

wherein one of the cylindrical protrusion apertures is a forward aperture at the top of the fixed cylindrical protrusion that is continuously exposed and exhausts gas to the environment as the sleeve reciprocates between a forward position and a rearward position as the firearm cycles;

wherein the firearm defines a vertical medial lane when in the standard firing orientation, and wherein the forward aperture opens at an angle offset laterally to the right of the medial plane;

wherein one of the body apertures is a rearward aperture adjacent to the top of the fixed piston that is not continuously exposed and exhausts gas to the environment only when the sleeve uncovers the rearward aperture as the sleeve moves to the rearward position;

wherein the rearward aperture opens upward at a forward angle relative to the barrel axis and at an angle offset laterally to the right of the medial plane.

25. The firearm of claim 24 wherein the forward angle is 70° and the rightward angle is 20°.

* * * * *